United States Patent [19]

Moebus

[11] 4,368,697

[45] Jan. 18, 1983

[54] LIQUID-COOLED PISTON FOR INTERNAL COMBUSTION ENGINES

[75] Inventor: Horst Moebus, Neckarsulm, Fed. Rep. of Germany

[73] Assignee: Karl Schmidt GmbH, Neckarsulm, Fed. Rep. of Germany

[21] Appl. No.: 240,449

[22] Filed: Mar. 4, 1981

[30] Foreign Application Priority Data

Mar. 5, 1980 [DE] Fed. Rep. of Germany ..... 3008330

[51] Int. Cl.[3] ..... F01P 3/10

[52] U.S. Cl. ..... 123/41.35; 92/186; 92/223; 123/193 P

[58] Field of Search ..... 123/41.35, 41.34, 193 P; 92/186, 222, 223, 231

[56] References Cited

U.S. PATENT DOCUMENTS 2,772,933 12/1956 Nichols ..... 123/41.35 X
2,833,668 5/1958 Dailey et al. ..... 123/193 P
4,083,292 4/1978 Goloff ..... 92/186 X
4,175,502 11/1979 Moebus ..... 123/41.35

*Primary Examiner*—William A. Cuchlinski, Jr.
*Attorney, Agent, or Firm*—Sprung, Horn, Kramer & Woods

[57] ABSTRACT

In a composite, liquid-cooled piston, the upper part consists of ferrous material and is joined by conventional means to the lower part. A ring is provided on the underside of the upper part which bears on the corresponding surface of the lower part and constitutes a radially inner boundary of a cooling passage which is disposed on the upper part and open to the interfacial plane. To improve the cooling action in the hottest regions of the upper part and to achieve a more uniform distribution of temperature in the ring carrying over of the upper part of piston, the upper portion of the wall defining the cooling passage is coated with a material having a high thermal conductivity.

6 Claims, 6 Drawing Figures

LIQUID-COOLED PISTON FOR INTERNAL COMBUSTION ENGINES

BACKGROUND OF THE INVENTION

This invention relates to a composite, liquid-cooled piston for internal combustion engines, particularly for medium-speed diesel engines, comprising a lower part which is connected by conventional means to an upper part which consists of ferrous material and a ring which is concentric with the upper part and is provided on the underside of the latter and bears on the opposite surface of the lower part and constitutes the radially inner boundary of an annular cooling passage which is disposed in the upper part behind the top land and at least part of the ring carrying portions of the upper part and open to the interfacial plane. The ring defines a central cooling chamber which is contained in the upper part and communicates with the cooling passage through radial coolant bores and is open to the interfacial plane, the cooling passage and the cooling chamber communicating with the coolant-circulating system by suitable coolant feed and discharge conduits which extend in the lower part substantially parallel to the longitudinal axis of the piston.

That composite piston is used in engines for very heavy duty and for an operation with heavy fuel oil. For this reason, cooling will always be required and will be effected as a forced-circulation cooling or as an injection cooling with shaker chambers as a standard design. The oil may flow through radially from the outside to the inside or in the opposite direction.

To minimize the dimension and weight of such composite pistons, the upper part of the piston consists of heat-resisting ferrous material, particularly forged steel, and the lower part consists of a eutectic aluminum-silicon piston alloy or of a ferrous alloy containing nodular graphite. The two parts are connected to one another by tie rods or screws or by soldered or welded joints, and cooling chambers are provided adjacent to the interfacial plane between the parts and serve to dissipate the heat which is generated at the top of the piston and cannot be dissipated otherwise Such pistons have, as a rule, a relatively shallow combustion recess so that the highest head temperature, which is generally between 350° and 400° C. or even higher, will occur at the inclined outer rim of the recess owing to the shape of the jets of injected fuel. In that case, temperatures of about 240° to 270° C. may occur in the corresponding region of the inside surface of the cooling passage, which inside surface is wetted by cooling oil. These temperatures result in yellow to blue temper colors on the surface of the steel and are close to or above the flash point of commercial lubricating oils for diesel engines. The experience had with such pistons in use sometimes supports the belief that the cooling oil tends to coke very fast and forms an insulating layer of oil coke in the region of the cooling passage and that that layer reduces the cooling action so that the temperatures are much higher and the strength of the piston material and particularly its creep resistance will be reduced and the thermal deformation will be increased. It has been observed in several instances that this may result in permanent deformation. These recognitions have induced the design of oil-guiding rings for guiding the stream of oil to the hottest regions so that the velocity of flow is increased and the surface temperature is decreased in the regions in U.S. Pat. No. 4,175,502.

Basic model investigations of the cooling system of composite pistons have shown that a major portion of the heat is transferred to the upper portion of the cooling chamber and that appreciable quantities of heat are not transferred to the lower portion of the cooling chamber. As a result, the temperature drops to 110° to 120° C. adjacent to the first piston ring so that there is an undesired condensation of $SO_3$, with all disadvantages involved therein, such as corrosion. Besides, the high concentration of heat on the outside surface of the head, resulting in temperatures of 300° to 350° C., will influence the stress concentration factor of the piston by thermal deformation.

SUMMARY OF THE INVENTION

It is an object of the present invention to improve the cooling action in the piston described hereinbefore in that the temperature in the hottest regions of the upper part of the piston is lowered so that the temperature is more uniformly distributed and the temperatures in the ring zone of the upper part of the piston are increased.

This object is accomplished according to the invention in that the wall adjacent to the upper portion of the cooling chamber is provided with a coating of a material having a high thermal conductivity and preferably a thickness of at least 0.5 mm.

This feature results in an optimum cooling action, which is particularly characterized in that a substantial part of the heat previously transferred through a limited surface of the upper half of the cooling chamber is now transferred through the surface of the entire upper half of the cooling chamber. This will result in a decisive temperature rise in the ring zone and in a lower temperature at the piston head so that a condensation of $SO_3$ in the ring zone will be avoided and the stress concentration factor of the piston will no longer be adversely affected. Besides, the efficiency of the dissipation of heat through the cooling passage will be improved so that, for a given cooling action, the surface and volume of the cooling passage may be reduced.

In the practice of the invention it has been found that the desired result may be produced if only that portion of the wall defining the upper part of the cooling chamber that is disposed on the outside of the piston is coated with a substance having a high thermal conductivity.

According to the preferred further feature of the invention, the coating has a heat-dissipating surface which is increased by the provision of ribs and which is wetted by the liquid coolant and increases the transfer of heat.

The coating consists preferably of pure copper or aluminum or alloys thereof.

The layer having a high thermal conductivity is suitably electrodeposited or is bonded to the ferrous material by a strong intermetallic bond in a casting obtained by double pouring.

Alternatively, the coating may be mechanically fastened or calked to the upper part of the piston.

In a modification of the invention, the coating is provided on the outside adjacent to the top land.

BRIEF DESCRIPTION OF THE DRAWINGS

The invention will now be explained in more detail with reference to illustrative embodiments shown in the drawings wherein.

DETAILED DESCRIPTION OF THE INVENTION

Figure 1:
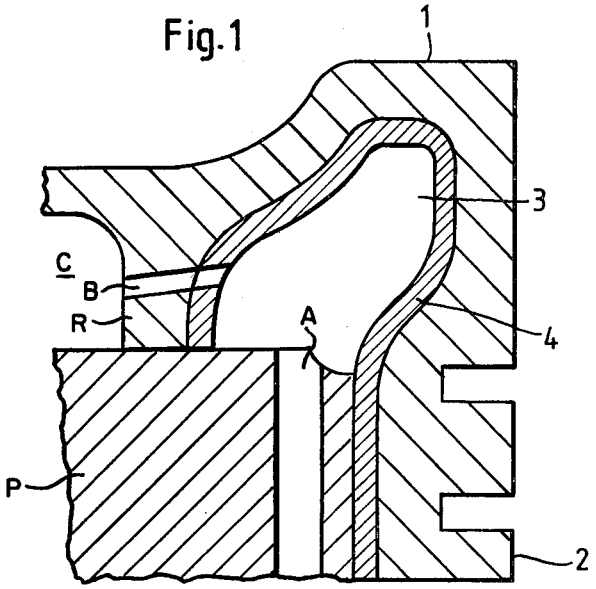
FIGS. 1–6 are transverse sectional views of the upper part of pistons according to the invention.

FIG. 1 shows the upper part 1 of a piston 2 adjacent to the cooling passage 3, which is provided with a coating 4 of electrodeposited copper.

FIG. 1 also illustrates lower part P with coolant passage A and ring R forming central cooling chamber C in communication with passage 3 through bore B.

Figure 2:
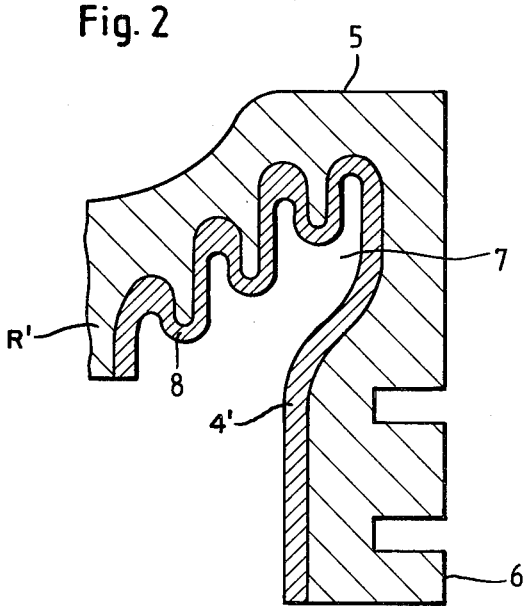

FIG. 2 shows the upper part 5 of a piston 6 adjacent to the cooling passage 7, which is provided with an electrodeposited coating 4', which on the piston head side has ribs 8.

Figure 3:
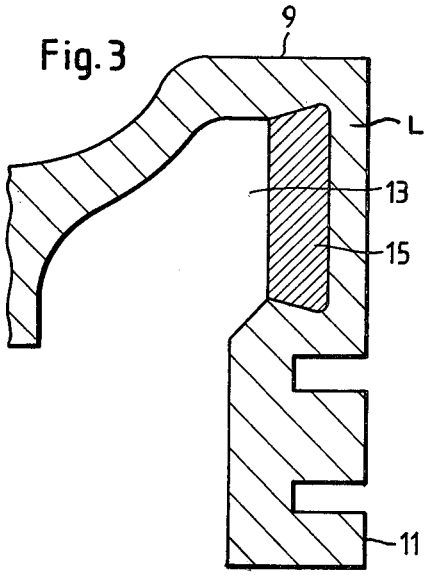
Figure 4:
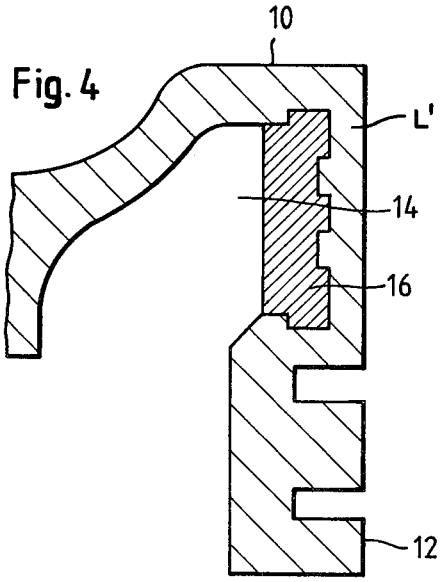

FIGS. 3, 4 show the upper parts 9 and 10 of piston 11, 12, respectively, adjacent to the cooling passages 13, 14, respectively. The wall of the cooling passage which adjoins the top land L,L' is provided with an aluminum coating 15 or 16, which is mechanically fastened to the upper part.

Figure 5:
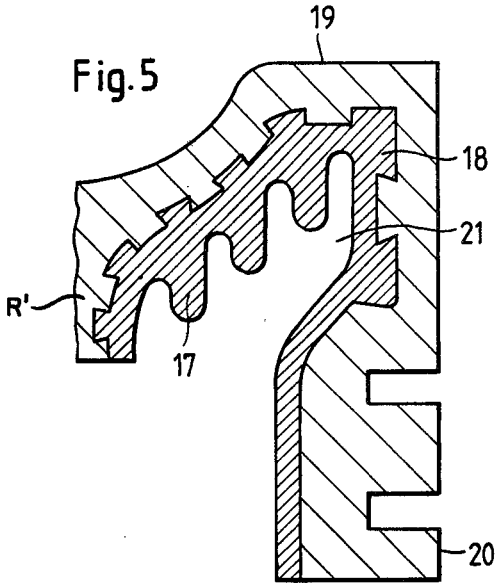

FIG. 5 shows the upper part 19 of a piston 20 adjacent to the cooling passage 21. The upper part 19 is provided with a coating 18, which is mechanically fastened and comprises ribs 17.

In the embodiments of FIGS. 1, 2 and 5 the surface of ring R,R',R" facing the cooling passage 3, 7 and 21 are also coated with coating 4,4' and 18.

Figure 6:
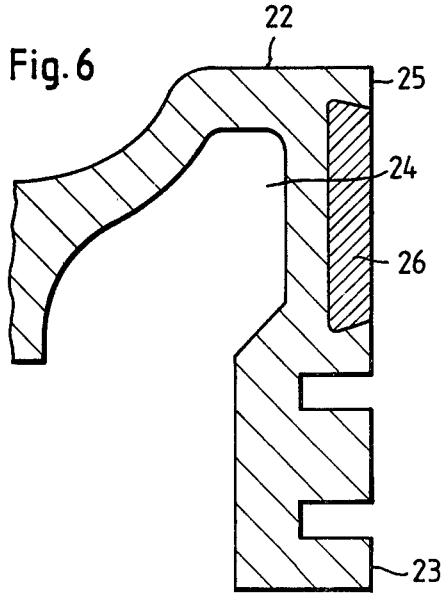

FIG. 6 shows the upper part 22 of a piston 23 adjacent to the cooling passage 24. Adjacent to the top land 25, the wall defining the cooling passage is provided with a mechanically fastened coating 26.

It will be appreciated that the instant specification and claims are set forth by way of illustration and not limitation, and that various modifications and changes may be made without departing from the spirit and scope of the present invention.

What is claimed is:

1. In a composite liquid-cooled piston for internal combustion engines, of the type having a lower part connected to an upper part composed of ferrous material and including a top land, a ring carrying portion therebelow, a ring bearing on the upper surface of the lower part to form the radially inner boundary of an annular cooling passage in communication with a central cooling chamber and disposed in the upper part behind the top land and at least part of the ring carrying portion and open to the interfacial plane of the two parts, the improvement comprising a coating of material having a higher thermal conductivity than the upper part and disposed on the inside wall of the upper part at least behind the top land thereof.

2. The piston according to claim 1, wherein the coating has a thickness of at least 0.5 mm.

3. The piston according to claim 1 or 2, wherein the coating has a heat-dissipating surface including ribs for enlarging the surface area thereof.

4. The piston according to claim 1 or 2, wherein the coating having a high thermal conductivity is bonded to the ferrous material by a strong intermetallic bond in a casting obtained by double pouring.

5. The piston according to claim 1 or 2, wherein the coating having a high thermal conductivity is electrodeposited on the ferrous material.

6. The piston according to claim 1, wherein the coating is mechanically fastened to the inside wall of the upper part of the piston.

* * * * *